United States Patent [19]

Okada

[11] Patent Number: 4,548,146

[45] Date of Patent: Oct. 22, 1985

[54] METHOD OF AND APPARATUS FOR SEWING TOWEL FABRIC END

[76] Inventor: Takanori Okada, 1941 Minamitahara, Ikoma-shi, Nara-ken, Japan

[21] Appl. No.: 447,006

[22] Filed: Dec. 6, 1982

[51] Int. Cl.[4] ..... D05B 1/00

[52] U.S. Cl. ..... 112/262.3; 112/315; 112/147; 112/143; 112/305; 112/121.26

[58] Field of Search ..... 112/121.26, 147, 305, 112/141, 143, 315, 262.3

[56] References Cited

U.S. PATENT DOCUMENTS

| | | | |
|---|---|---|---|
| 2,138,633 | 11/1938 | Greenfield et al. | 112/141 |
| 3,277,851 | 10/1966 | Dobner et al. | 112/141 X |
| 3,600,220 | 8/1971 | Marforio | 112/147 |
| 3,906,878 | 9/1975 | Burton | 112/305 X |
| 4,066,025 | 1/1978 | Speer | 112/147 |
| 4,068,603 | 1/1978 | Arbter | 112/147 |

*Primary Examiner*—Ronald Feldbaum

*Attorney, Agent, or Firm*—Wenderoth, Lind & Ponack

[57] ABSTRACT

There is disclosed a method of finishing lengthwise both ends of a towel fabric by sewing after automatically forming a three-ply part on each and, and an apparatus for practicing this method.

At each end of the towel fabric, a first part and a second part to wrap up the first part are folded automatically in turn so as to form a three-ply part including the above two parts and a ground fabric part.

Selvages extending outwardly slightly farther than crosswise both ends of the first and the second parts are formed on both ends of the ground fabric part of the three-ply part. The three-ply part thus provided with selvages is stitched from one selvage side to the other with sewing thread so that automatic folding and sewing of the three-ply part can be performed without causing the crosswise end of the first and the second folded parts to jut out from crosswise both ends of the towel fabric.

2 Claims, 18 Drawing Figures

METHOD OF AND APPARATUS FOR SEWING TOWEL FABRIC END

BACKGROUND OF THE INVENTION

1. Field of the Invention

This invention relates to a method of and an apparatus for automatically sewing and finishing both ends of each piece of towel fabric cut off from a long material fabric and, more particularly, to a method of and an apparatus for forming first and second folded parts as well as a three-ply part including the above two parts at the end of the towel fabric, and sewing the three-ply part in such manner that both ends of the first and the second folded parts do not jut out from the three-ply part.

2. Description of the Prior Art

The manufacture of towel fabric comprises processes of cutting a long material fabric into pieces, folding each end of cut piece in three, and then finishing by sewing the folded part so as to wrap up the cut end internally.

In the case of seaming the three-ply part as above, a simple sewing operation without application of any expedient means causes the cut end corners 22 to jut out from crosswise both ends of the three-ply part 21 as shown in FIG. 1.

That is to say, a process of finishing the end of the towel fabric consists of folding the towel end in two, folding additionally the two-folded part for forming a three-ply part 21, and stitching crosswise the edge of the two-folded part to the ground fabric part, which covers the folded part and is laid down as a bottom during processing, with sewing thread 23.

The cut end, therefore, is made free in crosswise movement within the three-ply part 21 and wider than other parts because of the elongation thereof caused when cut.

Accordingly, simple sewing of the three-ply part 21 causes protrusion of the cut end corners 22 to crosswise both sides as described above and is followed by such problems as affecting the shape of the finished product as well as reducing the commercial value thereof.

A way of solving such problems is to crosswise stretch the ground fabric part laid at the bottom when the three-ply part 21 is sewn and, while keeping it stretched, perform stitching so as to adapt the cut end corners 22 to lie within the width of the towel fabric.

Finishing of the towel fabric end including folding and sewing has depended on manual operaton so far and is attended by disadvantages as requiring skilled workmanship and high cost for operation as a result of low efficiency.

An operation to crosswise stretch the ground fabric part only during sewing is very troublesome and requires a length of time, resulting in raising costs for finishing and being inapplicable to other kinds of towel than those of high grade.

In seaming the three-ply part by means of a sewing machine, the sewing thread 23 must be prevented from being unsewn from both edges of the towel fabric and, therefore, backstitches have so far been applied to both edges of the sewn part.

Provision of a device for automatic backstitching, in which the feeding direction of the sewing machine needle is reversed at the start and end of stitching so as to obtain lapping stitches in an appropriate length, makes the fabric conveying system extremely complex in structure, large in size, and high in cost for production.

When making up a piece of towel by cutting off this piece from an elongate material fabric, weft is broken if the cutting direction is not parallel with the running direction thereof, whereby entanglement of weft threads takes place, or puckering occurs during use. Puckering is undesirable because it deforms the towel into a diamond shape, even if sewing is complete.

Since the towel fabric is soft and readily deformed, and, particularly, weft thereof sinuates in various ways, cutting of the fabric in the direction parallel with the weft is substantially impossible but a quite important factor for increasing the commercial value of the towel.

OBJECTS AND SUMMARY OF THE INVENTION

An object of this invention, therefore, is to provide a method of folding the cut end of the towel fabric in three, stretching the bottom ground fabric of the three-ply part 21, and automatically sewing the three-ply part 21 so as to produce towels of high commercial value at high efficiency.

Another object of this invention is to provide an apparatus simple in structure but capable of embodying the above-described sewing method.

Still another object of this invention is to provide a sewing device capable of performing such sewing which will have the effect of preventing sewing thread 23 from being unsewn at both stitch ends.

A further object of this invention is to provide a sewing device capable of cutting the fabric in the direction parallel with the weft running direction.

The above and other objects and features of this invention will become apparent in more detail from the following description with reference to the accompanying drawings showing an embodiment of this invention.

DETAILED DESCRIPTION OF THE PREFERRED EMBODIMENTS

Figure 16:
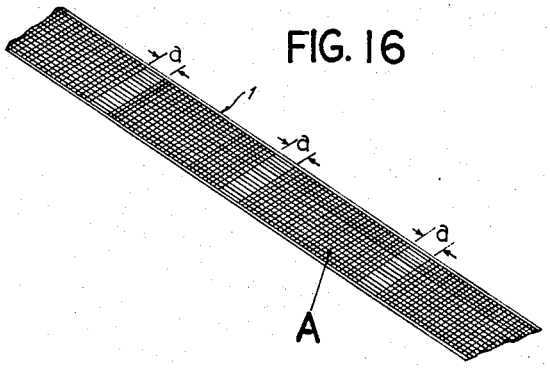
FIG. 16 is a perspective view of a material towel fabric to be subjected to sewing and finishing after being cut.

A long piece of towwel fabric A to be subjected to sewing by a method according to this invention is provided with, as shown in FIG. 16, weft-lacking areas "a" at certain intervals each about 1 cm long in the warpwise direction so as to be cut into short pieces thereat.

Figure 1:
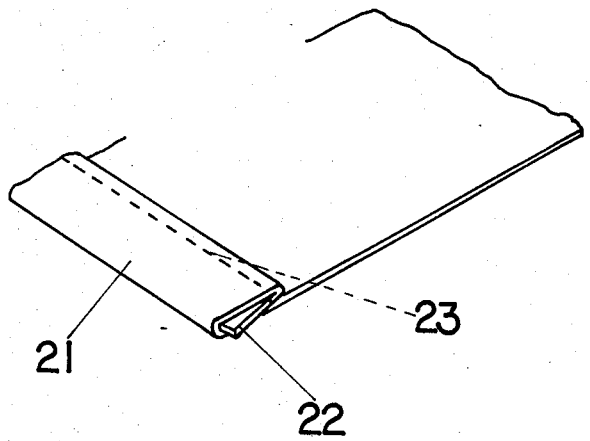
FIG. 1 PRIOR ART
FIG. 1 is a perspective view showing a conventional method of finishing the end of the towel.
Figure 2:
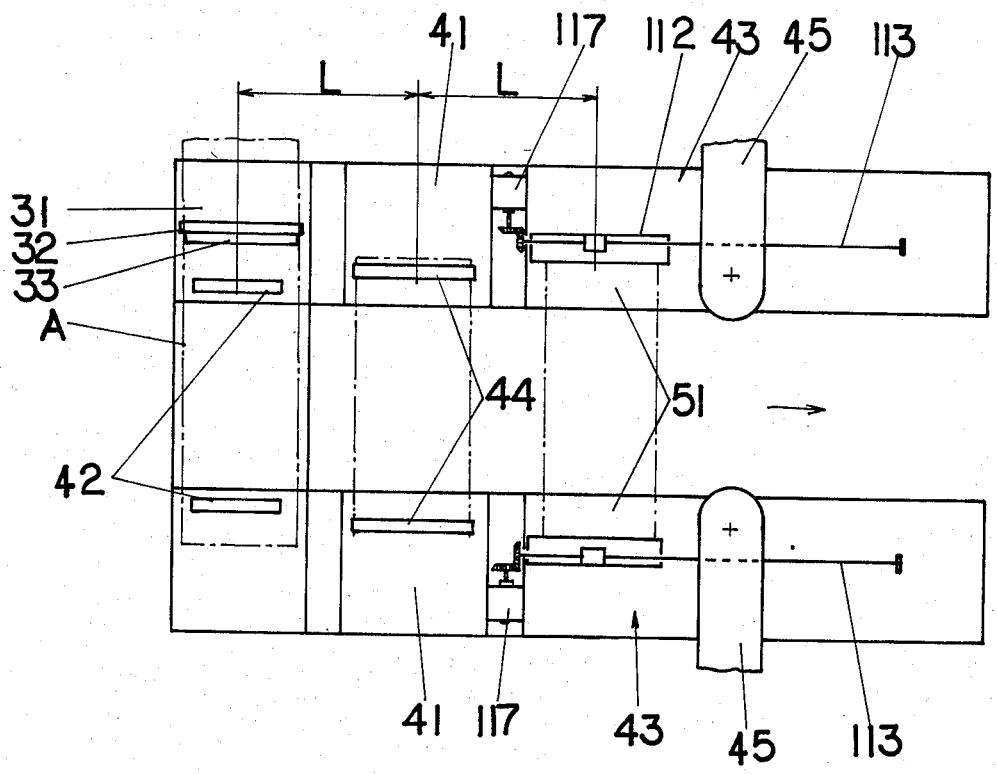
FIG. 2 is a plan view of an overall arrangement of a sewing apparatus.

A sewing apparatus is composed of, as shown in FIG. 2: a cutting means 31 for drawing a long piece of towel fabric A and cutting this long piece into short ones each having a certain fixed length; a pair of three-ply part forming means 41 disposed on both sides in front of the cutting means 31 with a distance L for forming three-ply parts 21 on lengthwise ends of the short towel piece A; a pair of first conveyors 42 for conveying the short piece of towel fabric A cut in a certain fixed length by the cutting means 31 to a fixed position in which the three-ply part forming means 41 are disposed; a pair of carriers 43 disposed on both sides in front of the three-ply part forming means 41 with a distance L; a pair of the 2nd conveyors 44 for conveying the towel piece A whose both ends are each provided with a three-ply part 21 to the carriers 43; and a pair of sewing machines 45, which are disposed on the midway point of the conveying path on which the towel piece A is conveyed by carriers 43, for sewing said three-ply part 21.

The above-described cutting means 31, although a detailed description is omitted, draws a certain length of the towel fabric A while clamping the end thereof, and a weft arranging mechanism 32 disposed on the midway point of the fabric conveying path detects the weft-lacking area "a" at which the fabric A is cut by a pair of cutters 33 disposed top and bottom into a short piece A of a certain length.

Figure 17:
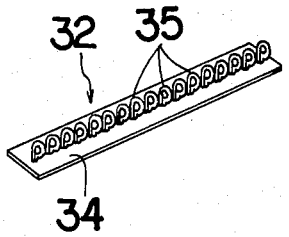
FIG. 17 is a perspective view of a comb-toothed part in the weft arranging mechanism.
Figure 5:
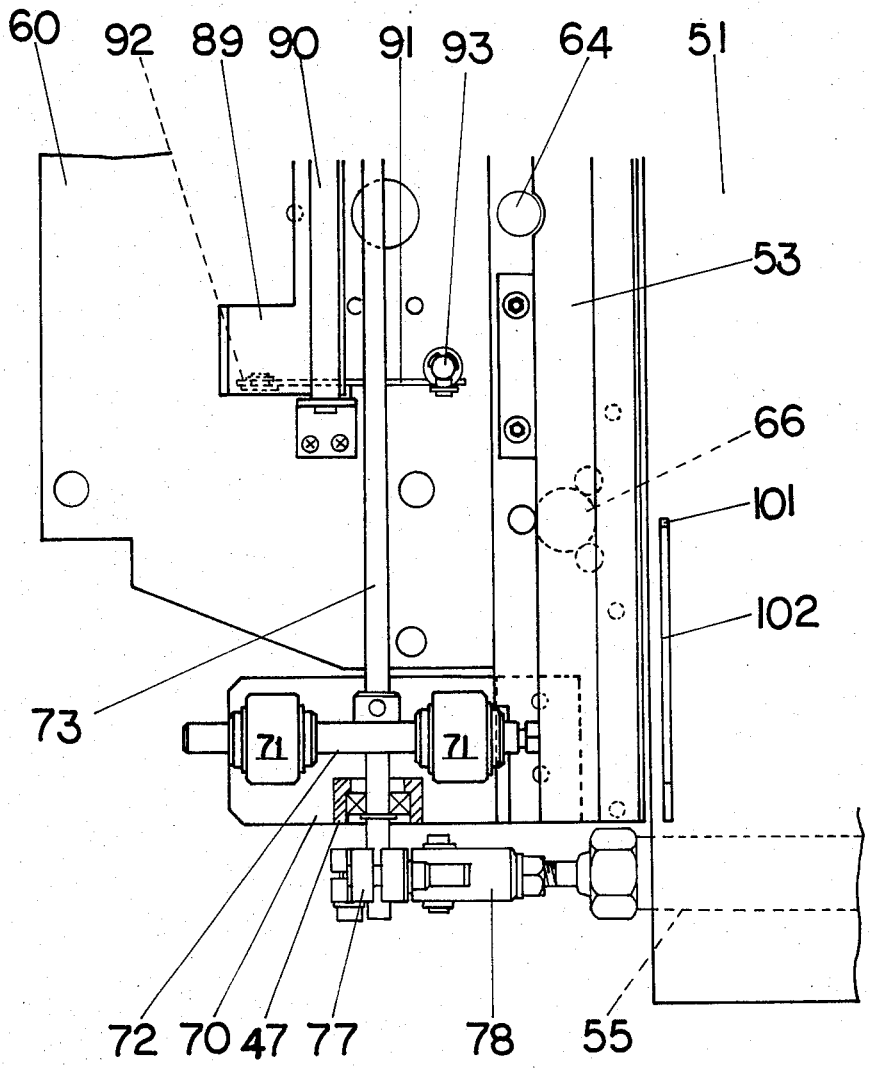
FIG. 5 is an enlarged plan view thereof.

The weft arranging mechanism 32 comprises, as shown in FIG. 17, comb-teeth consisting of loop like small projections 35 implanted at fixed short intervals in the weftwise direction of the towel fabric A on the strip-like support plate 34 arranged in the weftwise direction, too, and is disposed under the midway point of the fabric running path so as to push up the towel fabric A; and, when a weft-lacking area "a" reaches a position above small projections 35, warp threads in this area devoid of weft threads fall into gaps between small projections 35 and the weft in the succeeding part of the fabric A touches the small projections 35, thereby stopping advance of the fabric A.

Wefts are orderly arranged in line even if sinuating and then the weft-lacking area "a" is cut by the cutter 33, when cutting of long fabric into short pieces without breakage of weft can be ensured.

The foremost cut end of the succeeding piece of fabric is adapted to be pushed up above the weft arranging mechanism 32 by a boosting means so as to be clamped.

A pair of the 1st conveyors 42 are capable of moving reciprocally and vertically between the cutting means 31 and the three-ply part forming means 41. The first conveyors 42 then press both edges of the towel fabric A to the top face of the table in the cutting means, 31 advance toward the three-ply forming means 41 while keeping the towel fabric pressed down as above, and feed the fabric A to the fixed central position of the three-ply part forming means 41 while sliding the fabric A on the table.

Figure 3:
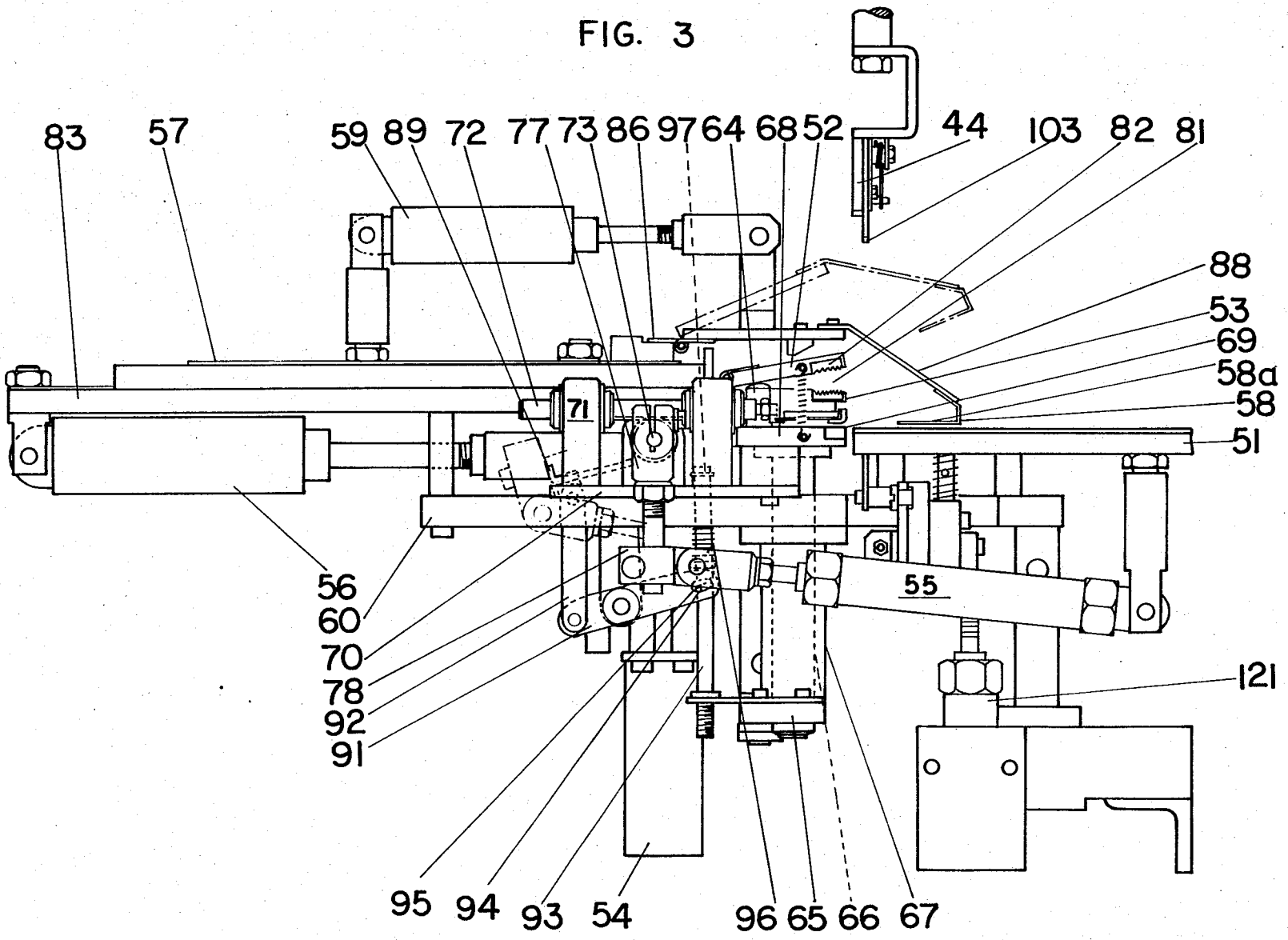
FIG. 3 is a front view of a part of the sewing apparatus for processing the three-ply part of the towel fabric.
Figure 18:
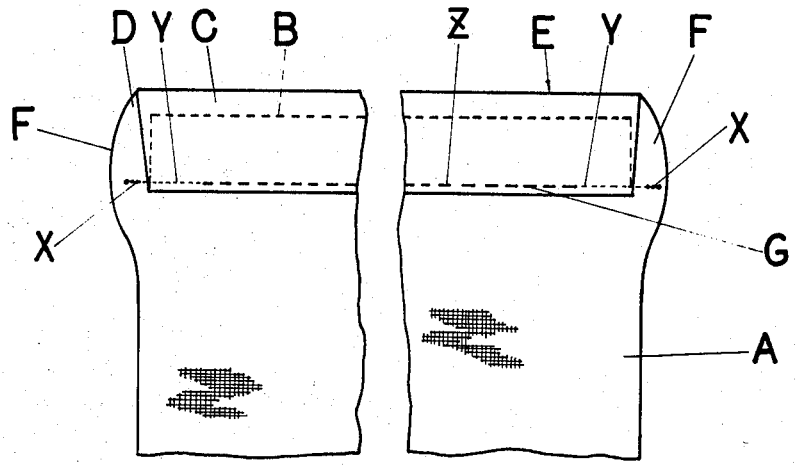
FIG. 18 is a plan view showing one end of the towel after being sewn.

The three-ply forming means 41 is composed of, as shown in FIG. 3: a pair of slit-forming members 52 and 53 disposed in proximity to the end of the table 51; a cylinder 54 for imparting vertical movement to the above members 52 and 53 and opening these members before the rise of these members; a cylinder 55 for imparting reciprocal movement to the bottom slit-forming member 53; a transfer table 57 disposed farther outside than the slit-forming members 52 and 53 so as to move back and forth with respect to the end of the table 51 by means of a cylinder 56; an insertion sheet 58 pivotally supported at the tip of the transfer table 57; and a cylinder 59 for imparting rise-and-fall movement to the insertion sheet 58; a second conveyor 44 disposed above the end of the table 51 so as to be vertically movable; a stretching mechanism disposed under the edge of the table 51 and fixedly provided just below said second conveyor 44 so that, as shown in FIG. 18, a three-ply part E consisting of a first part B folded upward, a second part C so folded as to wrap up the first part B internally, and a third part including the first and the second parts B and C overlapping with each other, is automatically formed.

Figure 4:
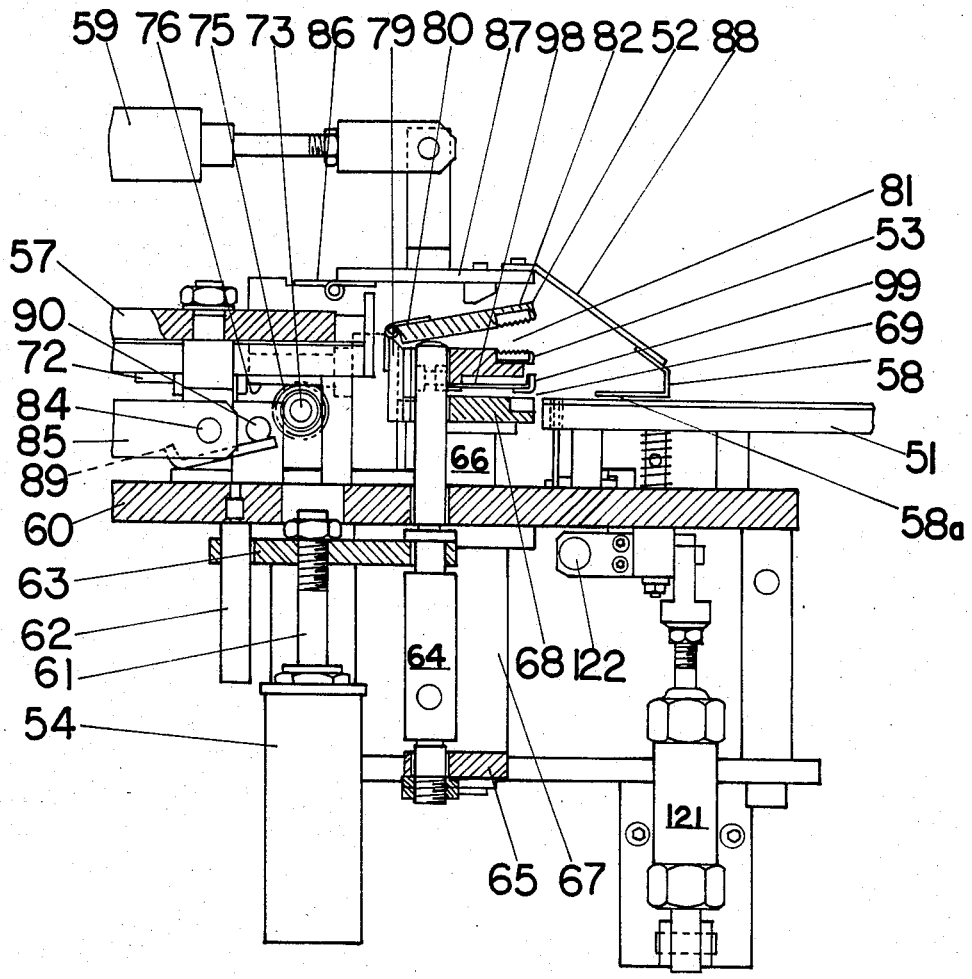
FIG. 4 is an enlarged front view of the main part thereof.

Referring to FIG. 4, a horizontal plate 60 is fixed to the underside of said table 51 at both ends thereof so as to outwardly protrude from the edge of this table 51, the cylinder 54 is fixedly provided under said plate 60 in such a manner that a piston rod 61 thereof is directed upward, and a lifting plate 63 vertically movable along a guide shaft 62 fixed to the underside of the plate 60 is fixed to the piston rod 61.

A shaft 64 vertically pierces through said lifting plate 63 so as to be capable of slightly moving up and down, a slightly movable plate 65 is attached to the bottom end of the shaft 64, and a lifting shaft 66 provided upright on the top surface of the plate 65 is guided by the retaining cylinder 67 fixed to the underside of the plate 60.

A horizontal table 68 is fixed to the upper end jutting out above the plate 60 of the lifting shaft 66. This horizontal table 68, whose edge faces closely the edge of the transfer table 51 as shown in FIG. 3, is made of a strip plate longer than the width of the towel fabric A.

The horizontal table 68 forms a second slit 69 in cooperation with the bottom slit-forming member 53 and, as shown in FIG. 3, ascends as high as the upper surface of the conveying table 51 when the cylinder 54 expands to the uppermost position whereas it descends as low as overlying the horizontal plate 60 when the cylinder 54 contracts to the lowest position.

Plates 70 are horizontally and fixedly provided under both ends of said horizontal table 68 so as to project in the direction opposite to the conveying table 51, and a horizontal shaft 72 is fixed to the top surface of this plate 70 through a pair of bearings 71 so as to be axially movable back and forth relative to the conveying table 51.

A shaft 73 in parallel with the horizontal table 68 is rotatably provided and supported by the bearing 74 arranged on the plate 70 above the area between plates 70 located at both ends of the horizontal plate 68, and. as shown in FIG. 4, a pinion wheel 75 is fixed to said shaft 73 at a part thereof intersecting the horizontal shaft 72.

A rack 76 meshing with said pinion wheel 75 is provided on the underside of the horizontal shaft 72 so that the horizontal shaft 72 moves back and forth according to the rotational direction of the shaft 73.

Returning to FIG. 3, an arm 77 projecting downwardly is fixed to one end of the shaft 73 and a piston rod of the cylinder 55 secured to the conveying table 51 is connected to a connecting piece 78 provided on the lower tip of said arm 77 so that swing motion of the arm 77 generated by expansion and contraction of the cylinder 55 may adapt the shaft 73 to turn in the normal and reverse direction at a certain degree of angle.

Returning to FIG. 4, the top slit-forming member 52 is secured to the upper end of an upstanding piece 79 on the rear edge of the horizontal table 68 through a hinge 80, so as to be capable of rising and falling, and the bottom slit-forming member 53 is secured to the tip of the horizontal shaft 72 and positioned between the horizontal table 68 and the top slit-forming member 52 so that the bottom slit-forming member 53 alone can approach and move away from the conveying table 51.

The top and the bottom slit-forming members 52 and 53 are each made of a strip plate of the same length as that of the horizontal table 68, and tips of both members 52 and 53 as well as of the horizontal table 68 are all in the same position when viewed from above and the bottom slit-forming member 53 is in the withdrawal position.

Both slit-forming members 52 and 53 are so constructed as to overlap each other when the top one 52 is in the horizontal position and the botton one 53 is in the withdrawal position, and to form a first slit 81 which opens at the side of the conveying table 51 between opposite surfaces of the overlapping two members 52 and 53.

On opposite surfaces of the slit-forming members 52 and 53 for the first slit 81, there are provided slip-preventive members 82 for preventing the towel fabric A put into said slit 81 from slipping outward.

Both slit-forming members 52 and 53 are arranged in such a manner that the open space of the first slit 81 is slightly higher than the upper surface of the conveying table 51 when the cylinder 54 contracts to its lowest position.

The shaft 64 fixed to the lifting plate 63 pierces through the plate 60 and the horizontal plate 68, as shown in FIG. 4; and the upper end thereof faces the rear part of the bottom slit-forming member 52 and rises higher than the lifting shaft 61 by the width of a gap between the plate 65 and the lifting shaft 64 which idly moves therewithin when the cylinder 54 expands, thereby boosting the top slit-forming member 52 by such rising motion as above and opening the first slit 81 by turning of the top member 52 as shown in FIG. 3.

Continuing with FIG. 3, a horizontal guard rail 83 is secured to the top surface of said plate 60 opposite to the conveying table 51 so that the transfer table 57 may be movable back and forth with respect to the conveying table 51 by means of this rail 83.

Said transfer table 57 is connected to the piston rod of the cylinder 56 disposed under the rail 83 through the pin 84 (FIG. 4 only) and the connecting piece 85 (FIG. 4 only) and is moved back and forth relative to the conveying table 51 in accordance with expansive and contractive movement of the cylinder 56.

An insertion sheet 58 is provided on said transfer table 57 at the tip thereof facing the side of the conveying table 51 so as to be capable of turning around a hinge 86 and a cylinder 59 is mounted on the transfer table 57 for turning this sheet 58.

As shown in FIG. 4, said insertion sheet 58 is fixed to the bottom tip of a downwardly directed sheet 88 fixed to the turning plate 87 which is fixed to the transfer table 57 with a hinge 86. The insertion sheet 58 is made of a metal strip longer than the width of the towel fabric A and bent into an approximate channel shape in cross section and an insertion piece 58*a* positioned at the bottom tip of the sheet 58 is laid so as to be horizontal immediately above the conveying table 51 when the cylinder 56 expands, thereby allowing the foremost edge of said insertion piece 58*a* facing the slit-forming members 52 and 53 to be grasped in the first slit 81.

When the slit-forming members 52 and 53 are in a low position, the first slit 81 and the insertion piece 58*a* are on the same horizontal level and, when the insertion sheet 58 is moved toward the side of the slit-forming members 52 and 53 due to contraction of the cylinder 56, the insertion piece 58*a* can enter the first slit 81.

When the slit-forming members 52 and 53 are in a high position, the second slit 69 and the insertion piece 58*a* are on the same horizontal level, and, when the bottom-slit forming member 53 is moved forward, the second slit 69 advances to a position above the insertion piece 58*a*.

Said insertion sheet 58 is raised by contraction of the cylinder 59, as said sheet 58 is shown by the alternate long and short dashed line in FIG. 3 and is adapted to withdraw from a position on the conveying table 51 to another position not interfering with the vertical movement of the second conveyor 44.

As shown in FIG. 4, to the center of the surface of the plate 60, a stopper 89 is fixed for controlling in two steps the expansive piston stroke of the cylinder 56 which imparts back-and-forth movement to the insertion sheet 58.

This stopper 89, whose base is secured to the shaft 90 provided on the plate 60, is turnable up and down, and, as shown in FIG. 3 the underside end thereof is connected to one end of the swingable link 91 pivotally provided under the plate 60 with a link 92, the other end of the swingable link 91 being connected, through a pin 94 and a long bore 95, with the middle part of a shaft 93 supported so as to be vertically movable by means of a plate 65 fixed to the bottom end of said shaft 93.

The upper end of the shaft 93 pierces through the plate 60 so as to be vertically movable and is constantly subjected to the downward resilient force of a spring 97 provided under the plate 60, being provided with a slip preventive pin 96 at a part thereof extending beyond the plate 60.

In such an arrangement as shown in FIG. 4, when the slit-forming members 52 and 53 are lowered by contraction of the cylinder 54, the stopper 89 is pushed upward and the pin 84 on the piston rod of the cylinder 56 (FIG. 3 only) abuts on this stopper 89, whereby the expansive stroke of the cylinder 56 is limited.

At this time, as shown in FIG. 3 the insertion sheet 58 is in such a position that the insertion piece 58*a* thereof approaches the slit-forming members 52 and 53.

As shown in FIG. 4 the lower part of the bottom slit-forming member 53 for forming the second slit 69 is made of a plate spring 98 which exerts pressure on said second sit 69 in the vertical direction, a pressing head 99 for thrusting the towel fabric being fixed to the tip of said plate spring 98.

The second conveyor 44 operates to: press creases of the first folded part B (FIG. 18) and the second part C included in the three-ply part E formed by the three-ply forming means 41 (FIG. 2) to the surface of the table 51; retain the three-ply part E (FIG. 18) after withdrawal of the slit-forming members 52 and 53 (FIG. 3); and slidingly feed the fabric A (FIG. 2) to the subsequent carrier 43 while retaining said fabric; and move reciprocally and vertically between the three-ply forming means 41 and the carrier 43.

The second conveyor 44 and the table 51 of the three-ply forming means 41 form selvage parts F (FIG. 18), each consisting of a folded part D extending outwardly farther than the crosswise ends of the two folded parts B and C in the three-ply part E when the fabric A is pressed.

Figure 6:
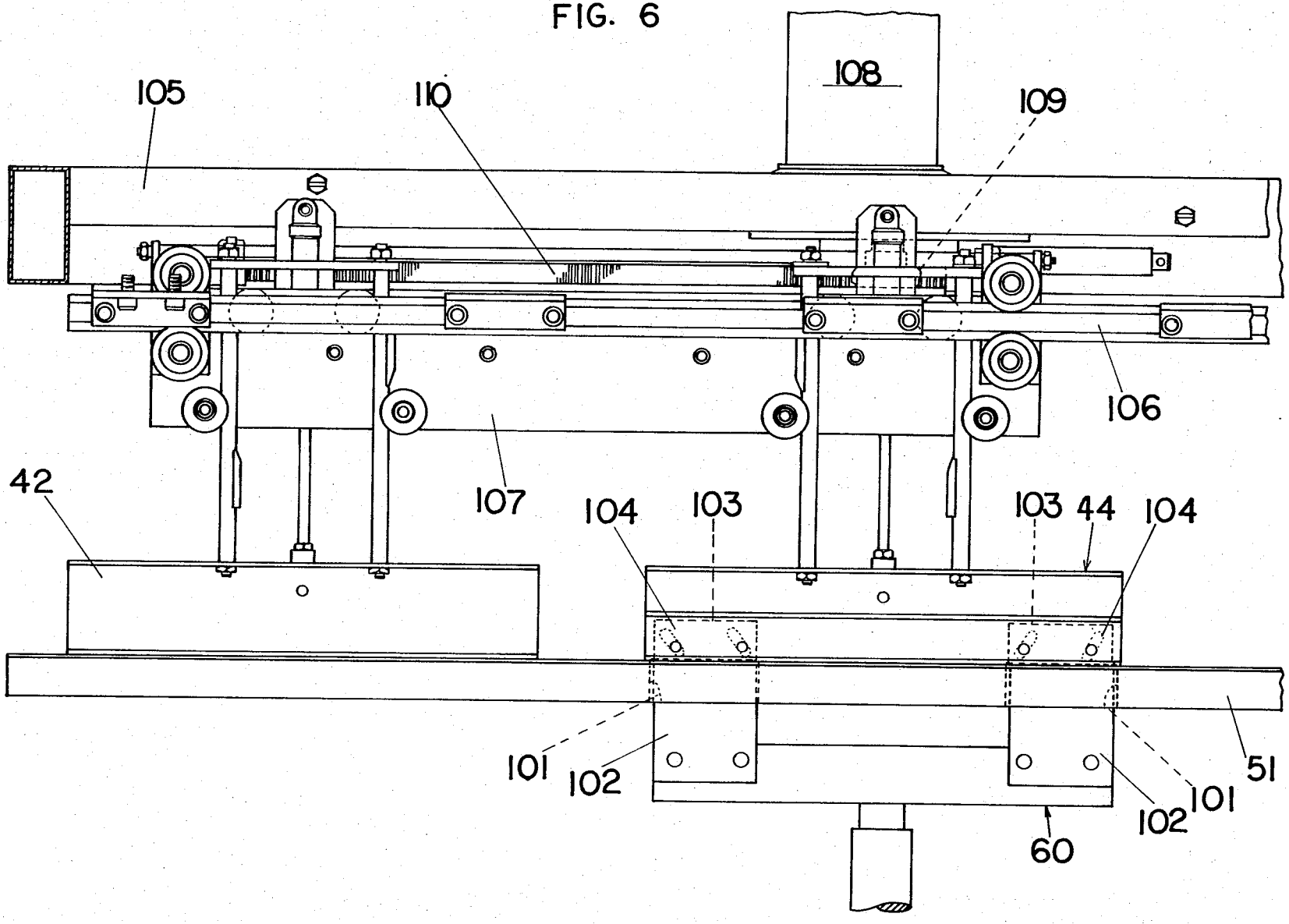
FIG. 6 is a side view of a towel conveyor in said apparatus.

In the case of selvage formation as shown in FIG. 6, long holes 101 are bored in the table 51 at both sides thereof in the crosswise direction of the towel fabric, opening dogs 102 are fitted into said long holes 101 so as to be moved by the cylinders 121 and 122 (FIG. 4) up and down and along long holes 101. As shown in FIG. 6, pressing dogs 103 are provided on both ends of the second conveyor 44 vertically movably through slanting long holes 104, so that, when the bottom rubber sheet of the second conveyor 44 presses the three-ply part E (FIG. 18), pressing dogs 103 of FIG. 6 press such parts as lying near the three-ply part and crosswise stretch the towel fabric with an outward shift thereof along slanting long holes 104, and opening dogs 102, too, move to the end part for stretching the towel fabric at the underside.

Besides the above-described means, another one such means pushing inwardly the first folded part B (FIG. 18) and the second folded part C only so as to be contracted and forming selvage on the folded part D may satisfy the purpose.

As shown in FIG. 2, the second, conveyor 44 moves forward while keeping selvage parts formed and delivers slidingly the towel fabric A from the three-ply forming means 41 to the center of the receiving carrier 43.

Returning to FIG. 6, the opening dogs 102 descend so as not to obstruct the conveyance of the towel fabric and, when the second conveyor 44 is used for conveyance, the first conveyor 42 is adapted to feed a new piece of towel fabric to the three-ply forming means 41 of FIG. 2.

As shown in FIG. 6, a track 107 movable along a rail 106 fixed to the frame 105 is adapted to reciprocate in a distance L shown in FIG. 2 by the motor 108 of FIG. 6 secured to the frame 105, and by a pinion 109 and a rack 110. As shown in FIG. 6, and the first conveyor 42 and the second conveyor 44 are vertically movably fixed to the underside of the track 107 at a distance equal to that L of FIG. 2 between the cutting part 31 and the three-ply forming means 41.

Figure 13:
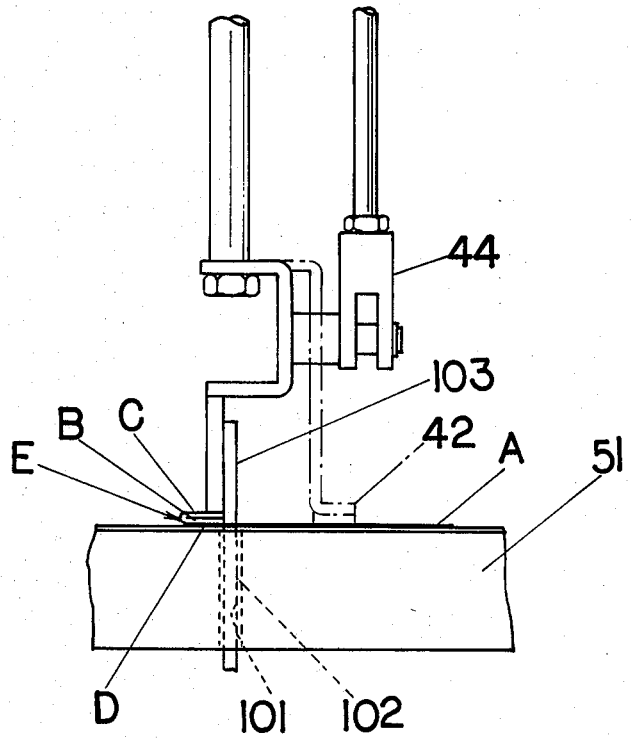
FIG. 13 is an enlarged front view of a second conveyor in the sewing apparatus.

As shown in FIG. 13, the three-ply part E is pressed by means of the second conveyor 44 at a place near the crease between the first folded part B and the second folded part C, this place being sewn by sewing machines 45 of FIG. 2 that will be described later.

Figure 15:
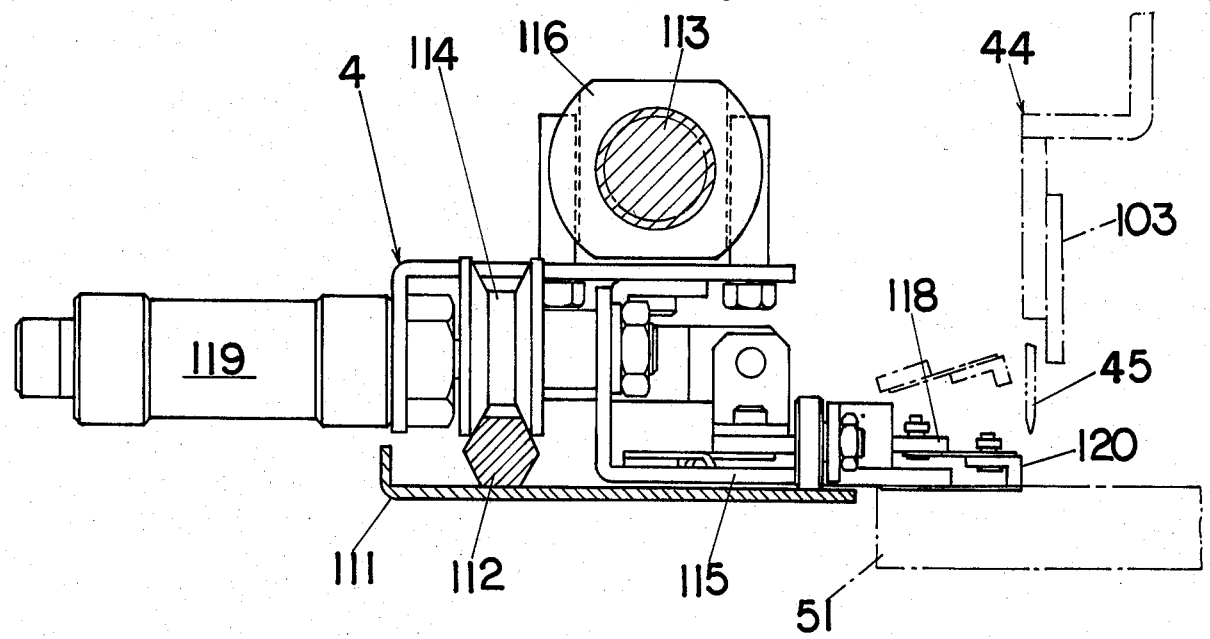
FIG. 15 is a vertical sectional side view thereof.
Figure 14:
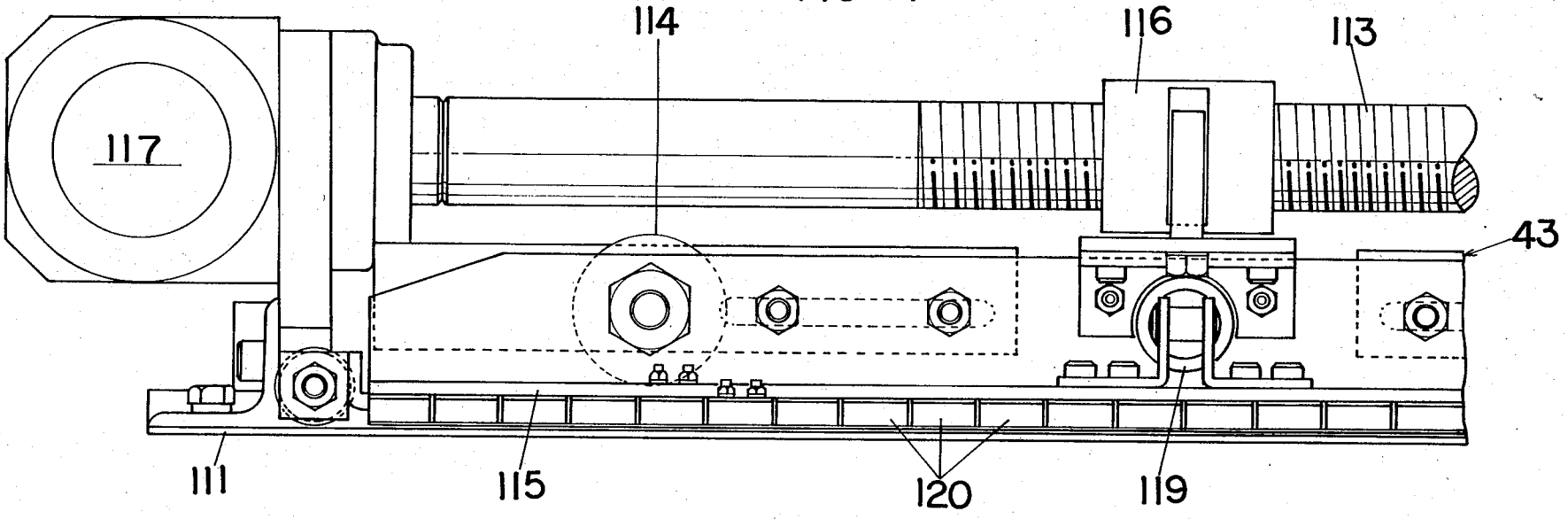
FIG. 14 is a vertical sectional front view of a carrier of said apparatus.

The carrier 43 is of such structure that, as shown in FIGS. 14 and 15, a base plate 111 is disposed near the sliding table 51 for conveying the towel fabric A conveyed by the second conveyor 44. As shown in FIG. 15, a rail 112 and a screw-threaded shaft 113 extending above said rail 112 are disposed on said base plate 111 in parallel with the direction of conveyance of the towel fabric; and a nut 116 meshing with the screw-threaded shaft 113 is connected to a movable table 115 supported by a wheel 114 rolling on the rail 112; and said movable table 115 is reciprocated by the screw-threaded shaft 113 driven in the normal and reverse directions by the motor 117 of FIG. 14.

Continuing with FIG. 15, a swingable plate 118 is fixed to the upper front edge of the movable table 115 facing the table 51, raised or lowered by the cylinder 119, and, further, provided with a large number of resilient pressing plates 120 aligned lengthwise on the tip thereof.

When said cylinder 119 contracts and the resilient pressing plates 120 are consequently raised, the towel fabric A is fed into the carrier 43 of FIG. 14 by the second conveyor 44 of FIG. 15 and the three-ply part E of FIG. 13 enters between the table 51 and a group of resilient pressing plates 120 shown in FIG. 15. When the towel fabric A of FIG. 13 is placed in a fixed position and the cylinder 119 of FIG. 15 expands, a group of resilient pressing plates 120 are lowered so as to press the three-ply part E of FIG. 13 to the table 51, whereby the three-ply part E having selvage parts F (FIG. 18) formed on both crosswise ends thereof is taken over from the second conveyor 44 of FIG. 15. When the second conveyor 44 rises and releases the towel fabric, the motor 117 of FIG. 14 is actuated for driving the screw-threaded shaft 113 in the normal direction and the movable table 115 moves forward so as to convey the towel fabric toward sewing machines 45 of FIGS. 2 and 15 disposed in front.

The sewing machine 45 stitches the three-ply part E (FIG. 13) of the towel fabric A slidingly conveyed on the table 51 by the movable table 115 with the sewing thread G (FIG. 18) and a stitch line running along the crease produced between the first folded part B and the second folded part C and jutting out from under the resilient pressing plates 120 of FIG. 15.

Movement, stoppage, and moving speed of the movable table 115 of FIG. 14 in said carrier 43 are electrically controlled by a towel fabric piece detecting device such as switches and phototubes arranged immediately under the sewing machine 45 of FIG. 15.

When the foremost end of the towel fabric A moved forward by the normal directional revolutions of the motor 117 of FIG. 14 reaches a position just under the sewing machine 45 of FIG. 15, feeding of said fabric A is stopped for a few seconds and, as shown in FIG. 18, fastening stitches X are applied to the fabric at a fixed position on the selvage part F several times on each side of the fabric.

Then, the motor 117 of FIG. 14 is driven at low speed for a few seconds for low speed feeding of the fabric, and, as a result of this slow feeding, as shown in FIG. 18, dense stitches Y are applied to the area covering the selvages F and the ends of the first folded part B and the second folded part C.

Upon finishing the dense stitching Y, the motor 117 is driven at the normal speed and regular stitching Z is performed, as shown in FIG. 18.

When the rear end of the towel fabric piece A approaches the sewing machine 45 in FIG. 2 with the continuation of regular stitching Z as shown in FIG. 18, the motor is driven at low speed again for slow feeding and dense stitching Y is performed in the area covering ends of the first folded part B and the second folded part C as well as selvage part F on the rearmost part of the fabric. And, when the selvage part F reaches a position just beneath the needle of the sewing machine 45 in FIG. 15, feed of the fabric is stopped for a few seconds, fastening stitches X shown in FIG. 18 are applied to the selvage part F, and then feeding is restored to normal speed for delivering the completely sewn fabric forward. The sewing thread G, drawn out to the space between fastening-stitch X and the sewing machine needle, is cut by the cutter 33 of FIG. 2.

In this way, the sewing thread G of FIG. 18 is prevented from being unsewn by the application of fastening stitches X to the selvage part F repeated several times, and, since ends of the two folded parts B and C are subjected to dense stitching Y, the end of three-ply part is prevented from being turned over. Such stitching operations as above can be performed by stoppage and reciprocal movement of the carrier 43 only, shown in FIG. 2, thereby enabling simplification of a control mechanism.

Then, a method of sewing according to this invention will be described.

The towel fabric A cut into a piece of certain fixed length at the cutting means 31 of FIG. 2 is fed to the three-ply forming means 41 by the first conveyor 42 and the three-ply forming means 41 forms a three-ply part E, as shown in FIG. 18, consisting of the first folded part B, the second folded part C, and the folded-part-lapping part D at the end of the towel fabric A.

Figure 7:
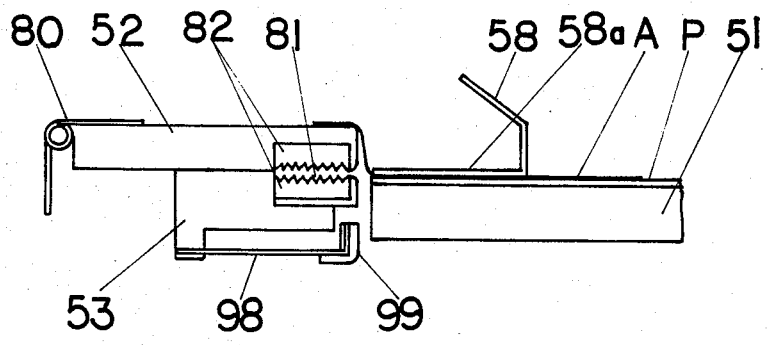
FIGS. 7 through 12 inclusive are views showing steps of folding the towel end in three.

When a piece of towel fabric is fed on the conveying table 51 of FIG. 3, the cylinder 56 expands until the piston thereof abuts on the stopper 89 raised high, so as to move forward the insertion sheet 58 to the side of the conveying table 51; and as the cylinder 56 further expands, the insertion sheet 58 lies down on the table 51 as shown in FIG. 7 and the insertion piece 58*a* horizontally faces the towel fabric A. The reference character P indicates a polished plate.

Figure 8:
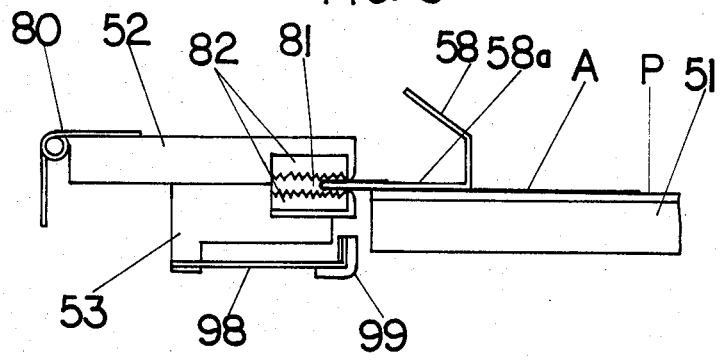

In this state, the cylinder 56 of FIG. 3 expands and contracts in order to move the insertion sheet 58 back and forth, thereby adapting the insertion piece 58*a* to enter the first slit 81 while drawing the towel fabric as shown in FIG. 8. Thus, the end of the towel fabric A is folded in two in the first slit 81 and the upper free end of the two-folded part B of FIG. 18 slightly protrudes, as shown in FIG. 8, from the slit-forming member 52 to the side of the conveying table 51.

The cylinder 56 of FIG. 3 expands after the formation of the two-folded part B of FIG. 18, and, as shown in FIG. 8, the insertion piece 58*a* outwardly slides while keeping the two-folded part B retained in the first slit 81.

Figure 9:
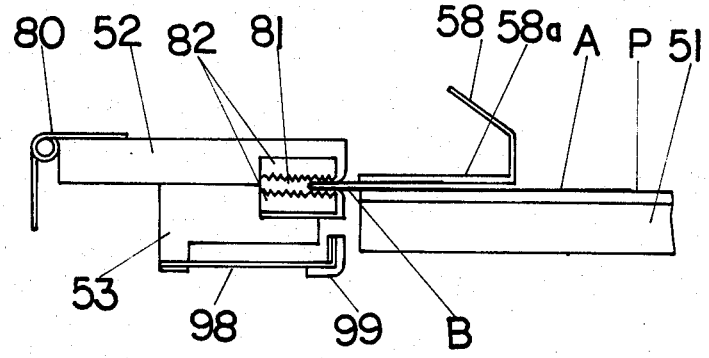

Subsequently, the cylinder 59 of FIG. 4 expands and contracts for raising and lowering the insertion sheet 58, and, as shown in FIG. 9, the insertion piece 58*a* depresses a part of the two-folded part B jutting out above the conveying table 51.

Figure 10:
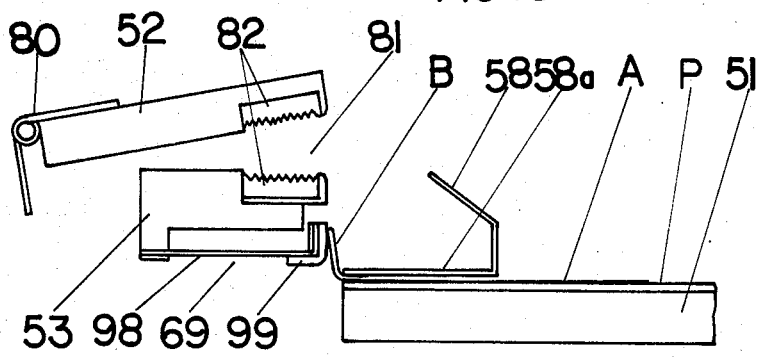

Then, the cylinder 54 of FIG. 4 expands and the shaft 64 rises so as to push up the top slit-forming member 52, thereby opening the first slit 81 as shown in FIG. 10. Since the lifting shaft 66 of FIG. 4 rises after the first slit 81 is opened by the shaft 64, the slit-forming members 52 and 53 also rise and the two-folded part B that has been made free in movement in the first slit 81 is pushed up by the bottom slit-forming member 53, whereby the two-folded part B slides outward from the first slit 81 and stands upright on the conveying table 51 as shown in FIG. 10.

When the slit-forming members 52 and 53 reach the top of the lift thereof, the cylinder 55 of FIG. 3 expands and drives forward the bottom slit-forming member 53 to the conveying table 51, as shown in FIG. 4, by means of the pinion wheel 75 and the rack 76.

Figure 11:
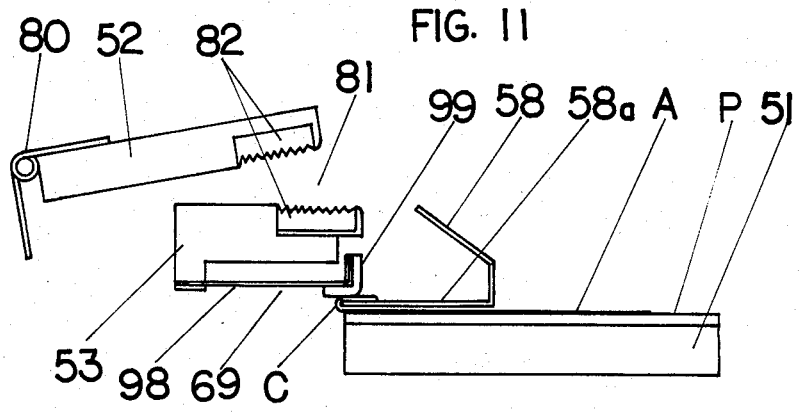

With the forward movement of the bottom slit-forming member 53, the pressing head 99 on the tip of the plate spring 98 forming the second slit 69 pushes down the upstanding one of the two-folded part B. As shown in FIG. 11, said upstanding part bends down around a fulcrum, that is, the tip of the insertion piece 58*a*, and is depressed, after overlaid on the insertion piece 58*a*, by the plate spring 98 so as to form the second folded part C.

The cylinder 59 of FIG. 4 expands and the insertion piece 58*a* further advances to the side of the conveying table 51 so as to slide out from the second folded part C of FIG. 18. In this case, the tip of the stopper 89 of FIG. 4 is lowered with the rise of slit-forming members 52 and 53, and the expansive operation of the cylinder 59 is made freely, the insertion sheet 58 being advanced to the extreme end of the expansion of cylinder 59.

With sliding out of the insertion sheet 58 from the second folded part C, as shown in FIG. 11, the cylinder 59 of FIG. 4 contracts and causes the insertion sheet 58 to rise, when the cylinder 56 of FIG. 3 contracts and returns to the withdrawal position.

Figure 12:
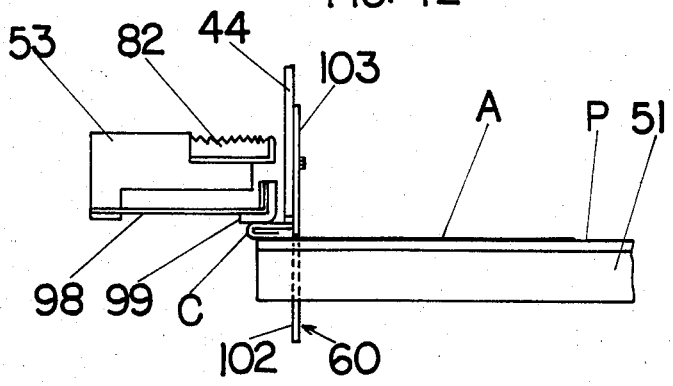

Then, the second conveyor 44 descends and, as shown in FIG. 12, pressing dogs 103 on both sides press the end of the first folded part B of FIG. 10 while touching a bottom-lying portion of the second folded part C of the towel fabric A of FIG. 12.

At the same time, the cylinder 54 of FIG. 4 expands so as to raise the opening dogs 102 of FIG. 12 fixed to the lower part of the conveying table 51, and then the opening dogs 102 are horizontally moved, while kept raised, by the expansive movement of a transversely moving cylinder 56 of FIG. 3.

Just when the bottom portion of the second folded part C shown in FIG. 12 is clamped by the pressing dogs 103 lying above and the opening dogs 102 lying below, said portion is stretched crosswise outwardly. Subsequently, the cylinder 55 of FIG. 3 contracts and, therefore, the slit-forming member 53 returns to the withdrawal position.

As a result, the lower portion of the second folded part C, as shown in FIG. 13, becomes wider than the first folded part B lying above the part C and causes crosswise both ends thereof to protrude, whereby both ends of the first folded part B lies within the width of the towel fabric A.

The second conveyor 44 moves forward while pressing the three-ply part E and feeds the towel fabric A to the carrier 43 of FIG. 2. The movable table 115 of FIG. 15 of the carrier 43 in the withdrawal position awaits the arrival of the towel fabric A and the three-ply part E enters between the table 51 and resilient pressing plates 120. With the finish of feeding of the towel fabric, the cylinder 119 expands and resilient pressing plates 120 clamp the three-ply part E, as shown in FIG. 13, in cooperation with the table 51, and, at this time, the second conveyor 44 rises to return to the withdrawal position.

When resilient pressing plates 120 of FIG. 15 clamp the three-ply part E, the motor 117 of FIG. 14 is actuated for conveying the towel fabric to the sewing machine 45, shown schematically in FIG. 15; and, by setting a cycle of feeding of the towel fabric to the sewing machine 45 to comprise the following steps: stop for a few seconds—slow feeding for a few seconds—ordinary speed feeding—slow feeding for a few seconds—stop for a few seconds—ordinary speed feeding". The three-ply part E of the towel fabric A of FIG. 13 that has been passed through the sewing machine 45 of FIG. 15 is sewn in the following pattern: fastening stitching X, dense stitching Y, ordinary stitching Z, dense stitching Y, and fastening stitching X with sewing thread G as shown in FIG. 18.

Upon completion of sewing, the resilient pressing plates 120 of FIG. 12 open and the movable table 115 returns to the withdrawal position at high speed.

As described above in reference to FIG. 13, cutting of the towel fabric a into pieces and formation of the three-ply part E are performed at almost the same time and repeatedly, thereby continuously applying automatic sewing-finish to the towel fabric ends as shown in FIG. 18.

According to this invention, completely automatic sewing at the three-ply part E of the towel fabric end has been made possible, thereby enabling great improvement in operation efficiency and significant reduction in operation cost.

Since the three-ply part E is sewn after formation of selvages F at both crosswise ends of the towel fabric A, an automatic operation to make up towel fabric having high commercial value is made possible and particular skilled workmanship for selvage formation is not required at all.

Further, because of the three-ply part E sewn with fastening stitches X, dense stitches Y, and ordinary stitches Z, the sewing thread G is prevented from slipping out or being unsewn at the end of the three-ply part E, thereby ensuring strong sewing, fulfilling the purpose by one-way driving of the fabric feed mechanism, and enabling simplification of the structure of the feeding mechanism, thanks to the omission of a feed reversing mechanism.

What is claimed is:

1. A method of sewing an end of a towel fabric, comprising the steps of :

cutting a piece of the towel fabric into a certain fixed length with two ends;

conveying the piece of the towel fabric onto a table;

folding at least one of the two ends of the piece of the towel fabric into a two-fold part;

moving an insertion piece into a slit formed between two slit-forming members so that the two-fold part of the piece of the towel fabric is grasped between the two slit-forming members;

withdrawing the insertion piece from the slit while the two-fold part of the piece of the towel fabric is retained in the slit between the two slit-forming members;

releasing the two-fold part of the piece of the towel fabric from the slit between the two slit-forming members by moving the two slit-forming members away from each other;

folding over the two-fold part of the towel fabric to form a three-ply part;

holding down the three-ply part of the piece of the towel fabric by pressing down with a pressing head upon a first end portion of the three-ply part;

clamping down a second opposite end portion of the three-ply part of the piece of the towel fabric so that there is exposed only a third middle portion of the three-ply part; and sewing the three-ply part of the piece of the towel fabric with sewing thread at a sewing machine on the exposed third middle portion thereof with a pattern of fastening stitches, dense stitches, ordinary stitches, dense stitches, and fastening stitches in that order;

whereby the sewing thread is prevented from slipping out or becoming unsewn at the three-ply part of the piece of the towel fabric.

2. An apparatus for sewing an end of a towel fabric, comprising:

means for cutting a piece of the towel fabric into a certain fixed length with two ends;

a table positioned next to the cutting means;

means for conveying the cut piece of the towel fabric onto the table;

means, arranged adjacent to the table, for folding at least one of the two ends of the piece of the towel fabric into a two-fold part;

two slit-forming members operatively connected to the folding means;

means, positioned on the table, for inserting the two-fold part of the piece of the towel fabric into a slit formed between the two slit-forming members;

cylinder means, connected to the inserting means, for withdrawing the inserting means from the slit;

teeth means, connected to the two slit-forming members, for grasping and retaining the two-fold part of the piece of the towel fabric in the slit between the two slit-forming members;

shaft means, cooperating with the two slit-forming members, for releasing the two-fold part of the piece of the towel fabric from the slit between the two slit-forming members;

means, arranged underneath the two slit-forming members, for folding over the two-fold part of the towel fabric to form a three-ply part;

head means, connected to the folding means, for pressing down upon a first end portion of the three-ply part of the towel fabric;

means, cooperating with the table, for clamping down a second opposite end portion of the three-ply part; and means, positioned on the table, for sewing the three-ply part of the piece of the towel fabric with sewing thread on an exposed third middle portion in a pattern of fastening stitches, dense stitches, ordinary stitches, dense stitches, and fastening stitches in that order.

* * * * *